US005468087A

United States Patent [19]

Tung

[11] Patent Number: 5,468,087

[45] Date of Patent: Nov. 21, 1995

[54] MEANS FOR FIXING A GORE TO RIBS OF A LARGE UMBRELLA

[76] Inventor: Pai-Feng Tung, No. 2, Chenghsing Rd., Sanmin Dist., Kaohsiung, Taiwan

[21] Appl. No.: 236,983

[22] Filed: Apr. 29, 1994

[51] Int. Cl.[6] ..... A45B 25/00

[52] U.S. Cl. ..... 403/294; 403/291; 135/33.5; 24/462; 24/536; 160/383

[58] Field of Search ..... 135/33.5, 33.4, 135/33.41; 24/459, 460, 462, 537, 536; 160/404, 402, 383; 403/291, 292, 294

[56] References Cited

U.S. PATENT DOCUMENTS

| | | | |
|---|---|---|---|
| 422,688 | 3/1890 | Armstrong | 135/33.5 |
| 699,424 | 5/1902 | Stouder | 135/33.4 |
| 1,264,076 | 4/1918 | Hout | 135/33.5 |
| 3,137,027 | 6/1964 | Birkle | 24/536 X |
| 3,214,810 | 11/1965 | Mathison | 24/536 |
| 3,354,516 | 11/1967 | Small | 135/33.5 |
| 3,879,813 | 4/1975 | Shadwell | 24/459 X |

*Primary Examiner*—Anthony Knight
*Attorney, Agent, or Firm*—Jones, Day, Reavis & Pogue

[57] ABSTRACT

A fixing device includes a block including a cavity to snugly receive a distal end of an associated rib of a large umbrella and an engaging slot, The fixing device further includes a pair of clamping members each having a plurality of piercers on one surface for clamping a sewing edge of a gore and being fittingly received in the engaging slot of the block.

2 Claims, 5 Drawing Sheets

MEANS FOR FIXING A GORE TO RIBS OF A LARGE UMBRELLA

BACKGROUND OF THE INVENTION

1. Field of the Invention

The present invention relates to a means for fixing a gore to the ribs of a large umbrella used on beaches or in yards.

2. Description of Related Art

Large umbrellas may protect people from sunshine, wind etc. when enjoying leisure in yards or on beaches. However, the conventional large umbrella still has several drawbacks in its structure, e.g., the gore thereof cannot be fully extended and tends to be loosened.

The present invention is intended to provide an improved design to mitigate and/or obviate the above-mentioned drawbacks.

SUMMARY OF THE INVENTION

The present invention provides a fixing means which includes a block including a cavity adapted to snugly receive a distal end of an associated rib of a large umbrella and an engaging slot. The fixing means further includes a pair of clamping members each having a plurality of piercers on one surface thereof for clamping a sewing edge of a gore therebetween and being fittingly received in the engaging slot of the block.

In one preferred embodiment of the present invention, the engaging slot has a recess in one end thereof and each clamping member is substantially L-shaped and includes a relatively long section which is fittingly received in the engaging slot and a relatively short section which is fittingly received in the recess.

Other objects, advantages, and novel features of the invention will become more apparent from the following detailed description when taken in conjunction with the accompanying drawings.

DESCRIPTION OF THE PREFERRED EMBODIMENTS

Figure 6:
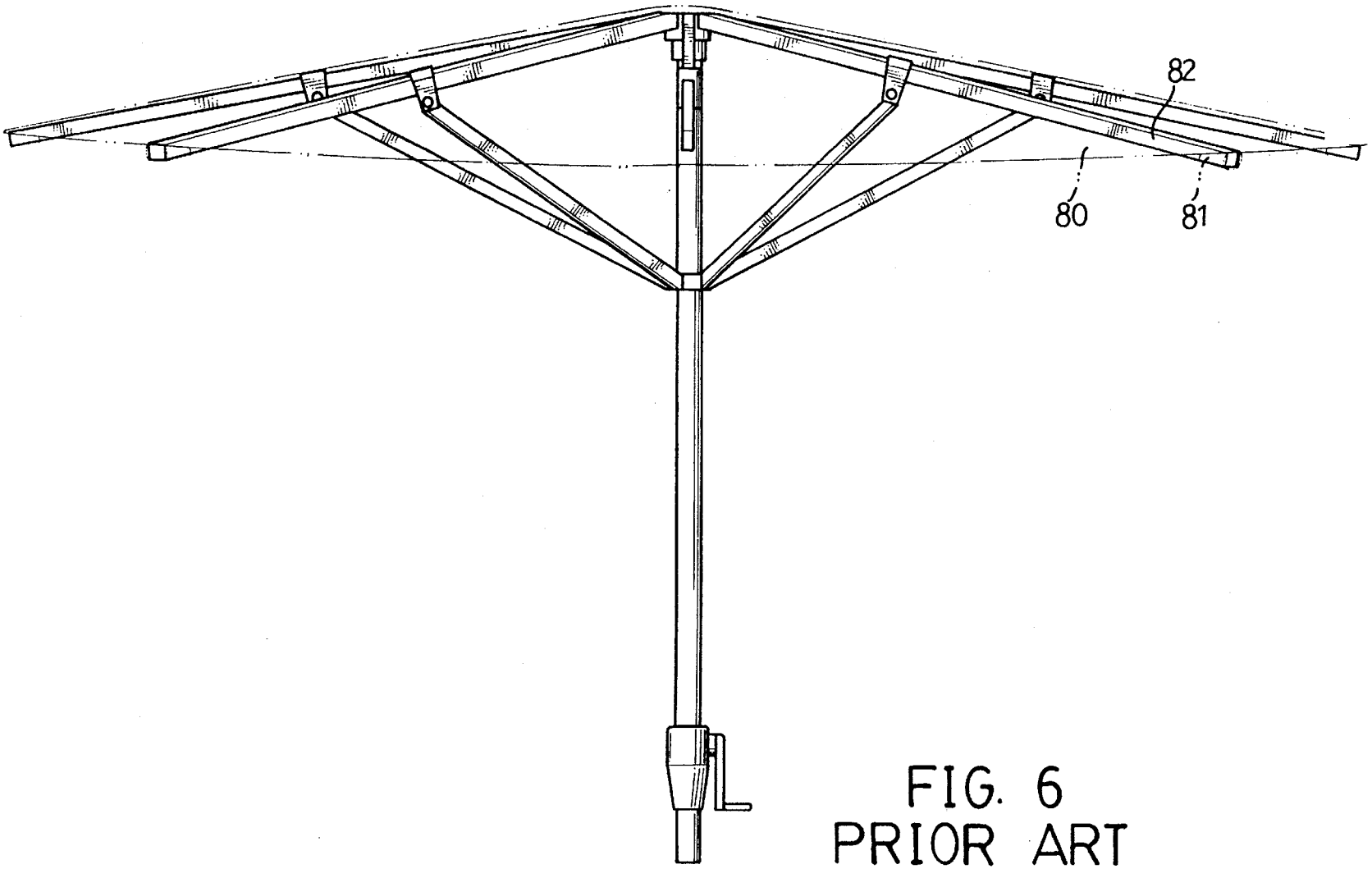
FIG. 6 PRIOR ART
FIG. 6 is a schematic illustration of a conventional large umbrella.
Figure 7:
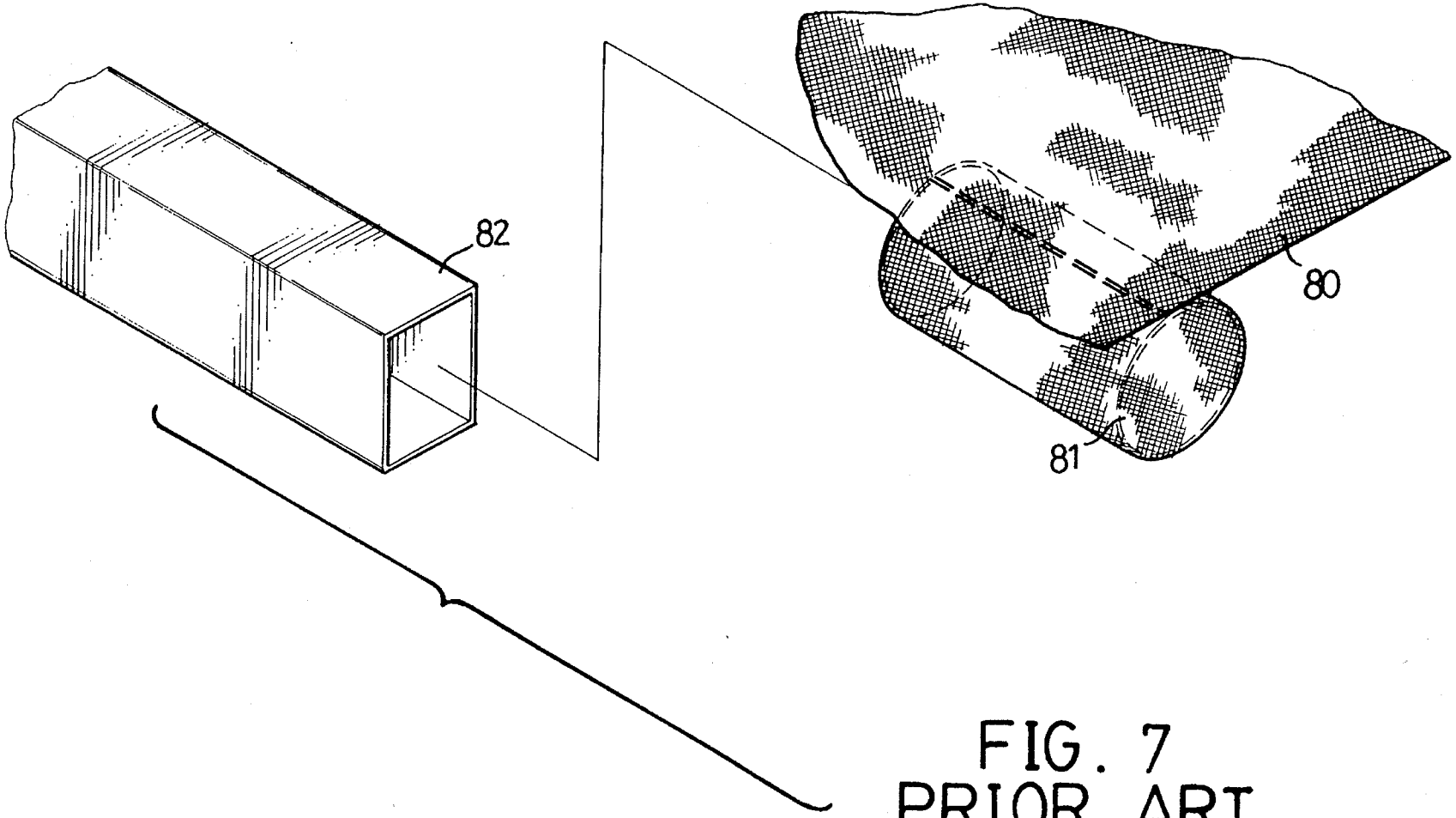
FIG. 7 PRIOR ART
FIG. 7 is an exploded view illustrating the rib and gore structure of the large umbrella in FIG. 6.

For a better understanding of the background of the invention, reference is firstly made to FIGS. 6 and 7 which shows a conventional large umbrella having a plurality of concentrically disposed ribs 82. A plurality of fabric sockets 81 are equidistantly sewn to a peripheral edge of a circular gore 80 which is then mounted to an upper side of the ribs 82 with one of two ends of each fabric socket engaged with an associated rib 82. However, since the fabric sockets 81 are manually sewn to the gore 80, if any inaccuracy occurs in the sewing positions, the gore 80 will be too loose in some areas and too tight in other areas. Furthermore, the sewing stitches, after several washings, may loosen and cause separation of the fabric sockets 81 and the gore 80.

To mitigate and/or obviate the above-mentioned drawbacks encountered in the prior art large umbrella structure, the present invention provides a fixing means to fix the gore to the ribs of the large umbrella.

Referring to FIGS. 1 through 4, the present invention provides a fixing means for fixing a gore 40 to the ribs 50 of a large umbrella. The fixing means includes a block 30 defining therein a cavity 33 for snugly receiving a distal end of an associated rib 50 and an inverted T-shaped engaging slot 31 in one side thereof for receiving a clamping means 20 consisting of a pair of clamping members 21 and 22 therein. Each clamping member 21, 22 is substantially L-shaped and has a relatively long, longitudinal section and a relatively short section 211, 221, a plurality of piercers 212, 222 are formed on one surface of the relatively long section. Preferably, the engaging slot 31 has a transverse recess 32 in one end thereof whose purpose will be explained hereinafter.

Figure 1:
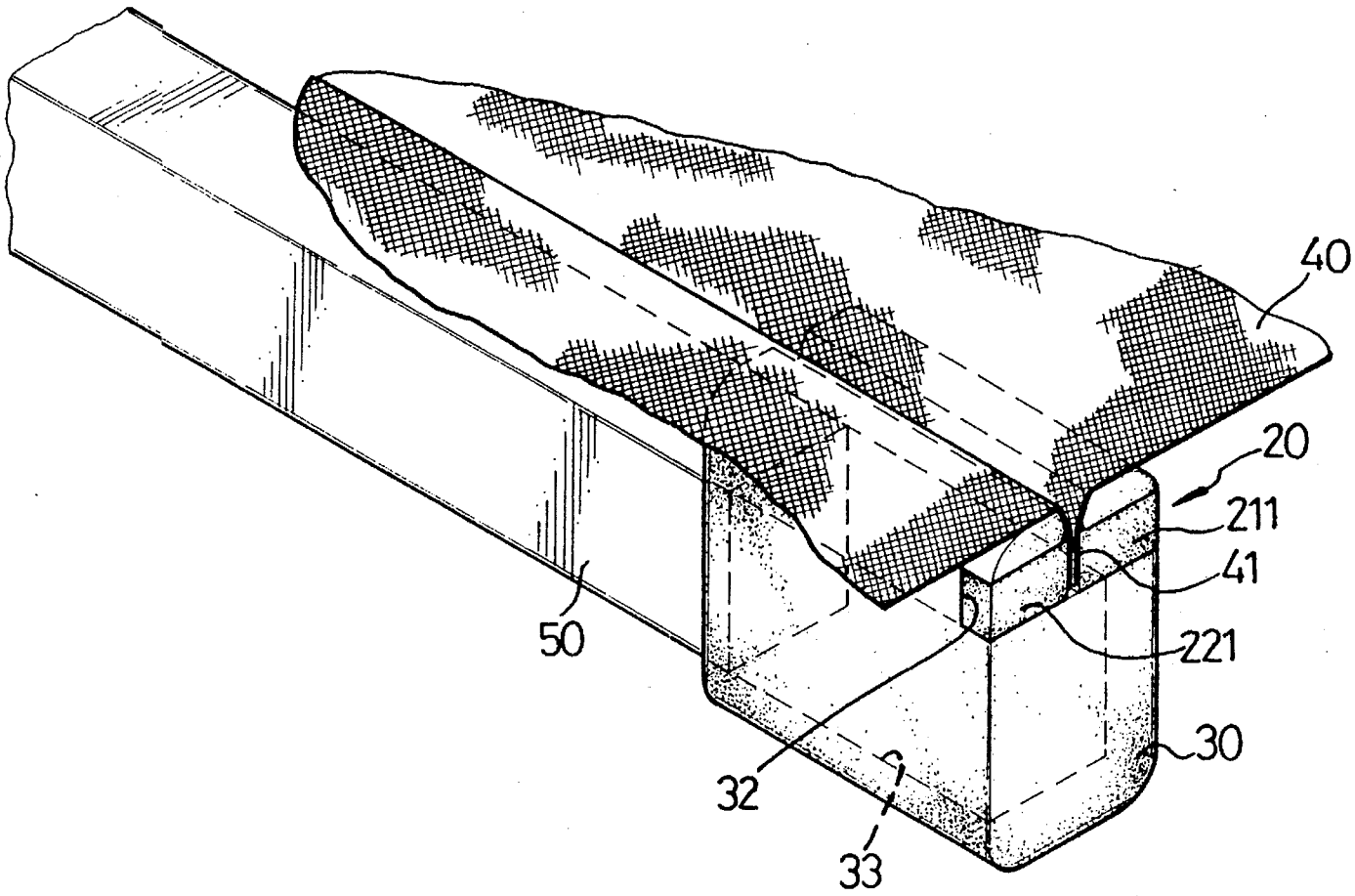
FIG. 1 is a partial perspective view of a rib of a large umbrella incorporating a gore fixing means in accordance with the present invention.
Figure 2:
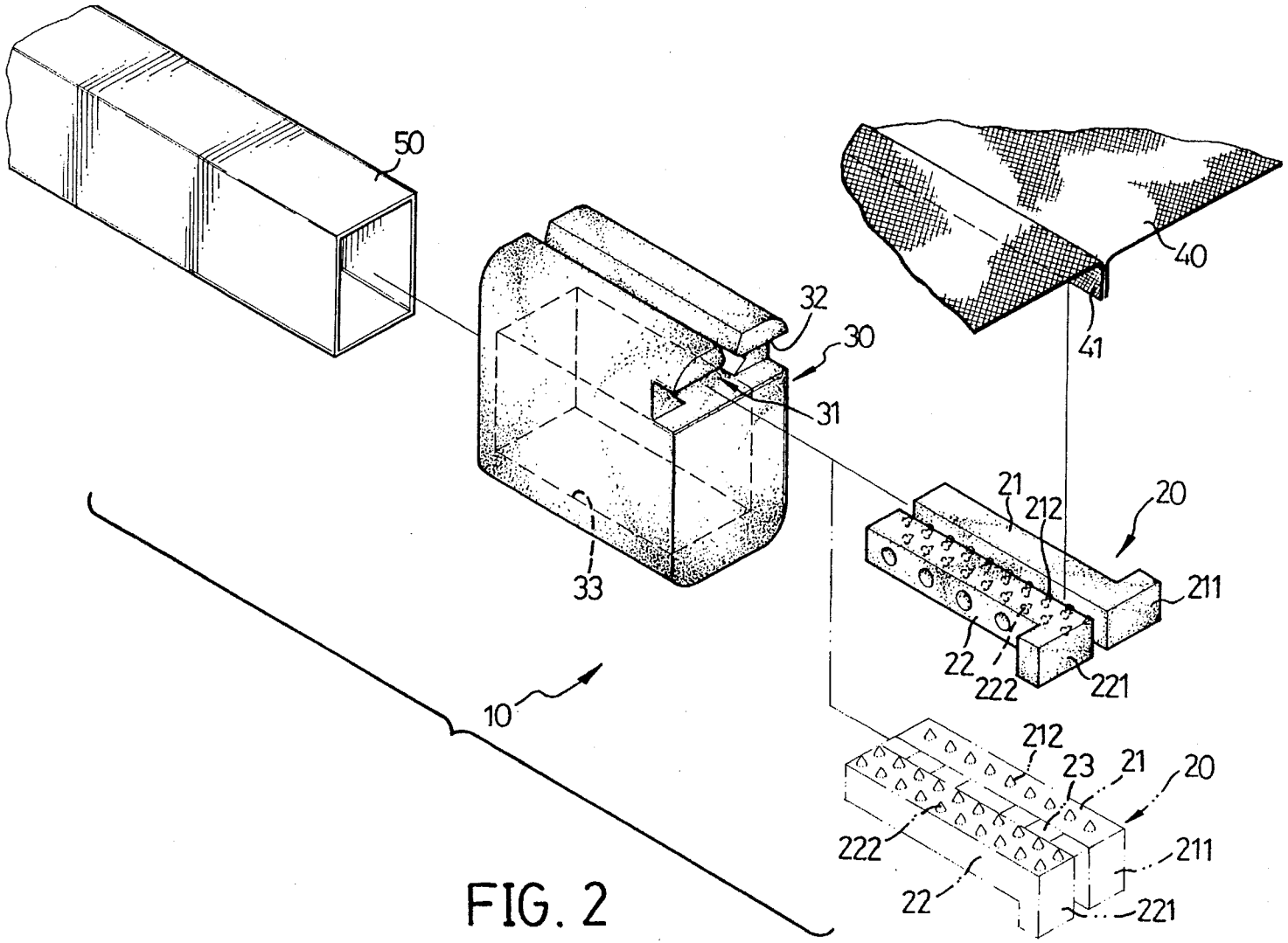
FIG. 2 is an exploded view of FIG. 1.
Figure 3:
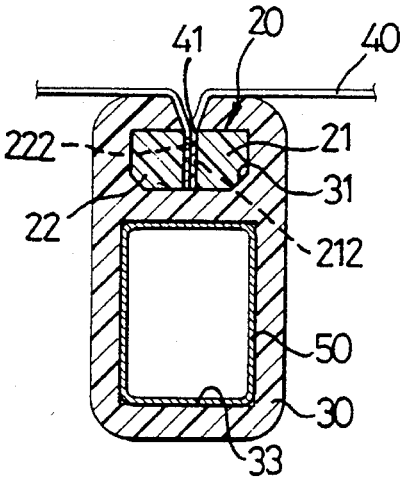
FIG. 3 is a vertical cross-sectional view taken along line 3—3 in FIG. 4.
Figure 4:
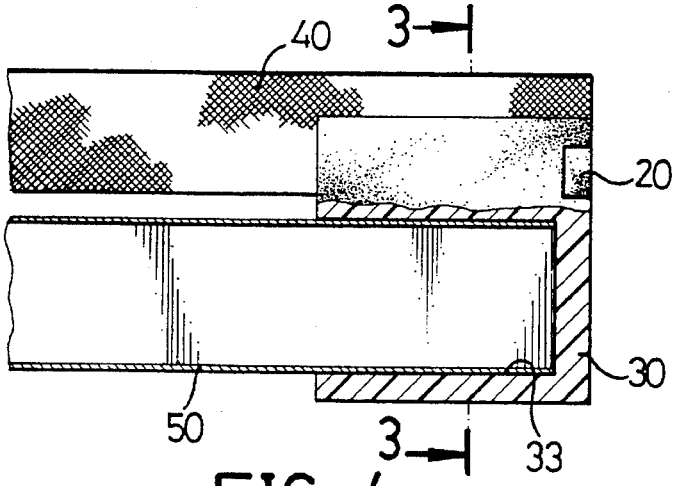
FIG. 4 is a vertical cross-sectional view sectioned from a longitudinal direction of the rib/gore fixing means in FIG. 1.

Initially, as shown by the phantom lines in FIG. 2, the clamping members 21 and 22 are linked by fragile bridge pieces 53. In assembly, the sewing edge 41 of the gore 40 is placed upon the fragile bridge pieces 23 between two clamping members 21 and 22. Thereafter, the clamping members 21 and 22 are turned through 90° such that the piercers 212 and 222 face and catch the sewing edge 41 of the gore 40, while the relatively short sections 211 and 221 are in-line. Then, the clamping, members 21 and 22 which have clamped the gore 40 therebetween are inserted into the engaging slot 31 in the block 30 with the relatively short sections 211 and 221 thereof fittingly received in the recess 32 of the block 30, while the distal end of each rib 50 is snugly received in the cavity 33 of an associated block 30 (see FIGS. 1 and 4).

Figure 5:
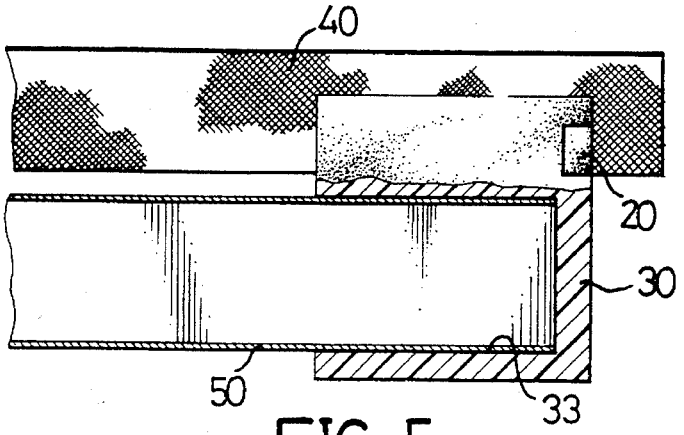
FIG. 5 is view similar to FIG. 4, illustrating another working embodiment of the invention.

If the gore 40 is too long for the ribs 50, the gore 40 may be clamped by the clamping means 20 at a position shown in FIG. 5, thus having a wider application.

According to the above description, it is appreciated that the present invention has the following advantages when compared with prior art:

(1) the gore 40 can be fully extended without leaving any area too loose or too tight;

(2) it is easy to assemble the gore 40 and the ribs 50 without any tool; and (3) the gore 40 is firmly clamped and shall not loosen even after several washings.

Although the invention has been explained in relation to its preferred embodiment, it is to be understood that many other possible modifications and variations can be made without departing from the spirit and scope of the invention as hereinafter claimed.

I claim:

1. A fixing means for fixing a gore with a plurality of sewing edges to a large umbrella having a plurality of ribs, said fixing means comprising:

a block including a cavity adapted to snugly receive a distal end of a rib of a large umbrella and an engaging slot; and a pair of clamping members each having a plurality of piercers on one surface thereof for clamping a sewing edge of a gore therebetween and being fittingly received in said engaging slot of said block.

2. The fixing means as claimed in claim 1 wherein said engaging slot has a recess in one end thereof and each said clamping member is substantially L-shaped and includes a relatively, long section which is fittingly received in said engaging slot and a relatively short section which is fittingly received in said recess.

* * * * *